US007396274B2

(12) United States Patent
Wiegmann

(10) Patent No.: US 7,396,274 B2
(45) Date of Patent: Jul. 8, 2008

(54) BICYCLE GARMENT

(76) Inventor: Holly Wiegmann, 3596 Pintail Dr. S., Jacksonville Beach, FL (US) 32250

( * ) Notice: Subject to any disclaimer, the term of this patent is extended or adjusted under 35 U.S.C. 154(b) by 29 days.

(21) Appl. No.: 11/435,220

(22) Filed: May 16, 2006

(65) Prior Publication Data

US 2006/0258262 A1 Nov. 16, 2006

Related U.S. Application Data

(60) Provisional application No. 60/681,500, filed on May 16, 2005.

(51) Int. Cl.
*A41C 3/00* (2006.01)
*A41D 1/22* (2006.01)

(52) U.S. Cl. ..... 450/89; 450/1; 450/76; 2/69; 2/105; 2/106; 2/73

(58) Field of Classification Search ..... 450/1, 450/58, 7, 8, 14–16, 20–32, 89; 2/74–76, 2/247–249, 69, 102, 94; 224/148.1, 148.2, 224/148.4, 148.5, 148.6, 148.7
See application file for complete search history.

(56) References Cited

U.S. PATENT DOCUMENTS

| | | | | |
|---|---|---|---|---|
| 1,844,888 | A | 2/1932 | Lorenz | |
| 4,372,320 | A | 2/1983 | Silber | |
| 4,398,538 | A | 8/1983 | Johnson | |
| 4,433,803 | A | 2/1984 | Liberboim | |
| 5,033,986 | A | 7/1991 | Feigenbaum et al. | |
| 6,099,382 | A * | 8/2000 | Wilson | 450/89 |
| 6,298,485 | B1 | 10/2001 | Heller | |
| 6,626,733 | B1 * | 9/2003 | Knutson | 450/89 |

* cited by examiner

*Primary Examiner*—Gloria Hale
(74) *Attorney, Agent, or Firm*—Thomas C. Saitta

(57) ABSTRACT

A bicycle shirt or similar garment having a relatively large pocket positioned on the back of the top, the top further comprising a torso-encircling elastic band, which is incorporated within the bottom opening of a shelf bra in the main embodiment, wherein the pocket is provided with an elastic band that is connected to the torso-encircling elastic band such that stress on the pocket elastic band is transferred or shared by the torso-encircling elastic band.

18 Claims, 2 Drawing Sheets

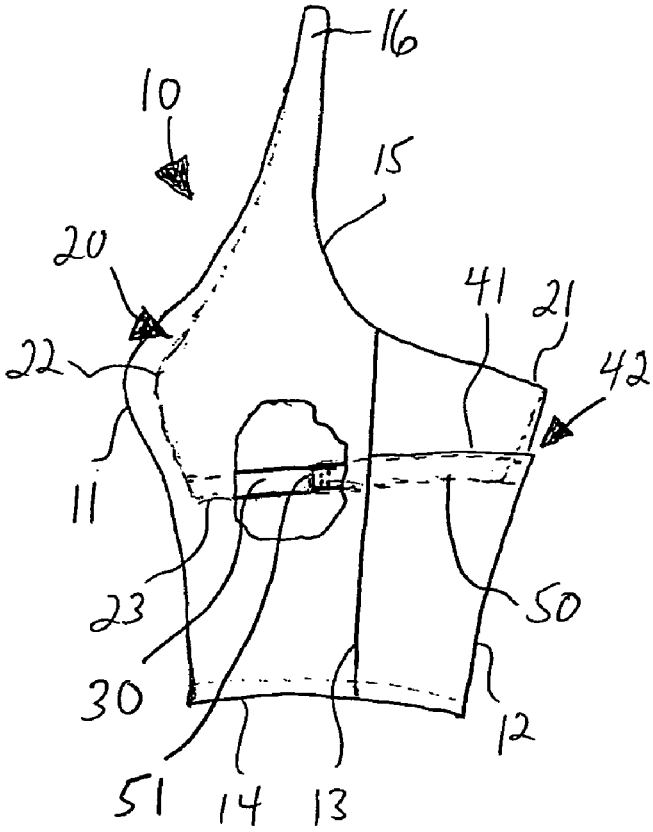
FIG. 4
FIG. 5
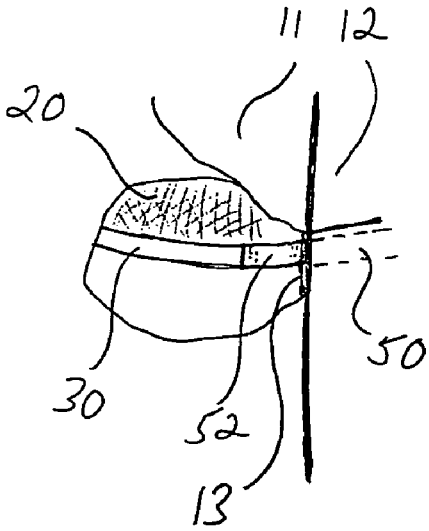

BICYCLE GARMENT

This application claims the benefit of U.S. Provisional Patent Application Ser. No. 60/681,500, filed May 16, 2005.

BACKGROUND OF THE INVENTION

This invention relates generally to the field of clothing shirts or tops, and more particularly to such tops composed completely or primarily of elastic material of the type worn during sports competitions or exercising, and most particularly relates to such tops designed and adapted to be worn during bicycling.

Specially designed shirts or tops composed of elastic fabric materials, such as Lycra or Spandex, usually referred to as bicycle tops, are often worn by serious riders. These bicycle tops are designed to fit snuggly for purposes of comfort and aerodynamics, and typically possess wicking or cooling characteristics that exceed those of other fabrics.

Bicycles used for racing or long distance riding are not equipped with baskets, pouches, bags or the like, as these would interfere with the aerodynamics of the bicycle by causing undesirable drag or wind resistance. However, it is usually desirable, especially on long rides, to bring bottled water, food or other supplies on the journey, and therefore bicycle tops have been designed with one or more pockets to retain these items. These pockets are almost always disposed on the back of the bicycle top, since the rider bends forward during the ride and placement of the pockets on the front or side would not provide optimum accessibility or comfort. Several problems result from locating the pockets on the rear of the bicycle top. For example, the pockets can trap air as the bicycle moves forward, thus acting like a sail and slowing the rider. A pocket with an unsecured opening may not adequately secure the items stored in the pocket. Over time, and especially if the pockets are loaded with heavy items or multiple items whose volume stretches the pocket, the pockets or the garment may become misshapen. Also, if the pocket is overloaded, the fit and comfort of the garment may be adversely affected.

To address these problems, it is known to incorporate an elastic band on the exposed edge or top hem of the pocket flap. The ends of elastic band may be sewn directly to the fabric comprising the bicycle top. The strength of the elastic band must be limited so that it does not damage the fabric material to which it is attached, meaning that relatively weak elastic bands must be utilized, thereby decreasing the ability of the pocket to retain the items. This structure results in undesirable stress points on the fabric, a misshaping of the garment, and can become uncomfortable over long time periods. This is especially true for women's bicycle tops that incorporate shelf bras within the interior of the garment. A shelf bra is typically constructed from an elastic fabric material and is attached to the fabric of the bicycle top along its upper hem. The bottom of the shelf bra is usually not directly attached to the top and is provided with a torso-encircling elastic band to properly position and retain the shelf bra on the wearer's torso.

It is an object of this invention to provide a novel construction for a bicycle top that addresses the above referenced problems. It is a further object to provide such a bicycle top wherein elastic bands of relatively high strength can be incorporated in the top without detrimental effect to the fabric material, the look of the top or the comfort of the wearer. It is a further object to provide such a bicycle top wherein stress on the pocket hem is transferred or shared with a body encircling elastic band.

SUMMARY OF THE INVENTION

The invention is in general a top or shirt garment, and is primarily constructed to function as a women's bicycle top incorporating a built-in shelf bra, such as typically composed of an elastic knitted or woven fabric, such as Lycra or Spandex, and having one or more pockets disposed on the back or rear of the garment. An elastic band is disposed along the entire length of the pocket opening, typically within a top hem. The pocket elastic band is directly joined or connected to the torso-encircling elastic band of the shelf bra, such that the stresses applied to the pocket are transferred to the elastic band of the shelf bra rather than to the fabric composing the bicycle top. The elastic band of the pocket may terminate within the side seams of the garment, with a short segment of elastic band connecting the ends of the pocket elastic band of to the shelf bra elastic band, or the pocket elastic band may pass completely through the side seams of the garment and be joined directly to the shelf bra elastic band by sewing or other suitable connecting means. Alternatively, the garment may be constructed such that a circular elastic band is disposed in the pocket hem and in the forward portion of the shelf bra, with a secondary elastic band being utilized for the rear of the shelf bra, this secondary elastic band being connected to the circular elastic band.

BRIEF DESCRIPTION OF THE DRAWINGS

FIG. 4 shows a cut-away side view of the bicycle top wherein the pocket elastic band extends through the side seam.

FIG. 5 shows a partial cut-away view where a bridging member is used to connect the shelf bra elastic band and the pocket elastic band.

DETAILED DESCRIPTION OF THE INVENTION

Figure 1:
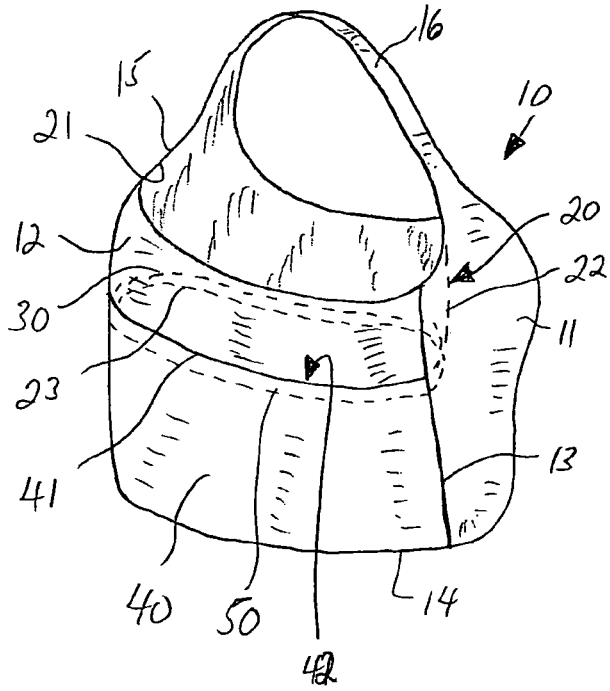
FIG. 1 shows a bicycle top of the invention.

The invention is a garment worn on the torso, i.e., a top or a shirt, and used primarily as active wear for sporting events, running, bicycling, etc. The garment may be composed of any known fabric material, and in particular may be composed completely or primarily of an elastic or stretch fabric, such as for example fabrics sold under the brand names Lycra or Spandex. Primarily, the invention is a garment of the type known as a bicycle top that further incorporates one or more pockets disposed on the back of the garment. For ease of reference, the invention shall be referred to herein as a bicycle top, with the term not being restrictive but being used to encompass any similar garment used in other sports or activities. Although the primary benefits of the invention are directed to bicycle tops manufactured for women that contain an integral shelf bra as part of the top, it is understood that the structure and function can be accomplished in a bicycle top for either gender.

A typical bicycle top 10 comprises a front 11, back 12, opposing side seams 13, a large waist or bottom opening 14, and a relatively large or small neck or upper opening 15 that may be designed to encircle the neck tightly, loosely or even distantly, such as in a halter top design. In the embodiment shown in the drawings, the bicycle top 10 is provided with a halter strap 16 that spans the upper opening 15, effectively dividing it into front and rear components.

A shelf bra 20, typically composed of elastic fabric material, is disposed internally to the bicycle top 10 as an integral member. The shelf bra 20 comprises an upper opening 21, a torso-encircling main body 22 of a generally cylindrical configuration, and a bottom opening 23. The perimeter of the shelf bra upper opening 21 is joined by stitching or other suitable means to the upper opening 15 of the bicycle top 10, while the perimeter of the lower opening 23 is usually not directly connected to the bicycle top 20, but instead hangs loose within the garment. A torso-encircling elastic band 30 is disposed about the perimeter of the shelf bra bottom opening 23, typically encased within a hem, such that the shelf bra 20 is retained snugly on the torso of the wearer.

At least one pocket 40 is provided on the back 12 of the bicycle top 10, the pocket 40 being relatively large and having an upper edge 41 that defines the access opening 42 for the pocket 40. An elastic band 50 is disposed along the pocket upper edge 41 and typically encased within a hem. The length of the pocket elastic band 50 is chosen so as to maintain the pocket 40 in a closed position unless stretched by the wearer for access or by the presence of items of large volume within the pocket 40. The pocket upper edge 41 and pocket elastic band 50 preferably extend completely across the back 12 of the bicycle top 10 from one side seam 13 to the other, although a pocket 40 and elastic band 50 of lesser width could also be utilized.

Figure 2:
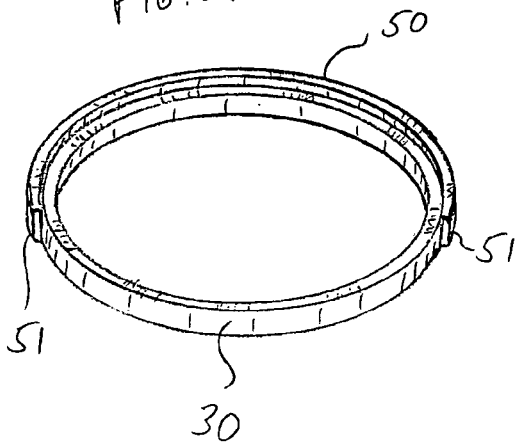
FIG. 2 shows an exposed view of the shelf bra elastic band and the pocket elastic band, as seen from the front.

In the preferred embodiment, the pocket elastic band 50 has a pair of ends 51 and the shelf bra elastic band 30 is annular, as shown in FIG. 2. The ends 51 of the pocket elastic band 50 extend beyond the sides of the pocket 40 and into or through the side seams 13. The ends 51 of the pocket elastic band 50 are connected to the elastic band 30 of the shelf bra 20, preferably by stitching, such that stresses applied to the pocket 40 by large water bottles or other items are transferred directly to the torso-encircling elastic band 30 of the shelf bra 20 rather than pulling directly against the sides of the bicycle top 10. This is accomplished structurally in one of two primary ways.

In a preferred embodiment, the ends 51 of the pocket elastic band 50 do not extend into the interior of the bicycle top 10 beyond the fabric composing the side seams 13. A pair of bridging members 52, preferably each an elastic band of similar size and strength to the pocket elastic band 50, are connected to the pocket elastic band 50, by stitching one end of the bridging member 52 through the side seam 13, and to the shelf bra elastic band 30, by stitching the other end through the hem, as shown in FIG. 5. The bridging member 52 is not required to be elastic, but use of an elastic material is preferred in order to maintain some degree of freedom for the shelf bra 20 relative to the garment 10. Alternatively, the bridging member 52 may be omitted and the shelf bra elastic band 30 connected to the pocket elastic band 50 by stitching passing directly through the side seam or fabric of the garment 10.

In another alternative embodiment, the ends 51 of the pocket elastic band 50 extend a short distance into the interior of the bicycle top 10 beyond the fabric composing the side seams 13, and each end is joined directly to the shelf bra elastic band 30, such as by stitching that passes through the hem containing the shelf bra elastic band 30, as shown in FIG. 4.

Figure 3:
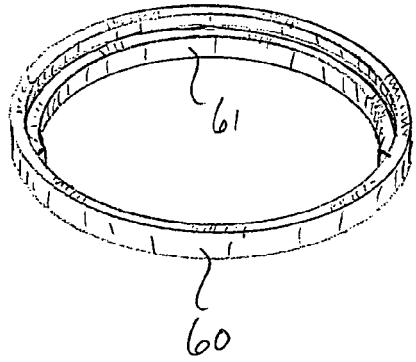
FIG. 3 shows an exposed view of an alternative embodiment for the shelf bra elastic band and the pocket elastic band, as seen from the front.

In still another alternative construction, a circular elastic band 60 is provided such that a forward portion is joined to the front portion of the shelf bra 20, the elastic band 60 passes through the side seams 13 or apertures provided in the fabric of the garment 10, and a rear portion is disposed along the upper edge 41 of the pocket 40. An elastic band segment 61 is then positioned within the back of the shelf bra 20 and joined to the front portion of the circular elastic band 60 adjacent the side seams 13, as shown in FIG. 3.

For a bicycle top 10 not containing a shelf bra, the torso-encircling band 30 is provided as apart of the top 10, either internally or externally, and the pocket elastic band 40 is connected to this torso-encircling band 30 in any of the alternative manners as described above. Such a top may be worn by males or females.

A bicycle top 10 as described above possessed multiple improved properties over the known constructions. The pocket opening 42 will remain tightly drawn against the wearer's back or snugly around any items extending from the pocket 40, thereby increasing retention and closure. The tight closure precludes a sail effect where wind is captured by the pocket 40. Stresses are passed through to the torso-encircling or shelf bra elastic band 30, thereby increasing comfort and preventing distress to the bicycle top fabric.

It is contemplated that equivalents and substitutions for certain elements set forth and described above may be obvious to those skilled in the art, and therefore the true scope and definition of the invention is to be set forth in the following claims.

The invention claimed is:

1. A bicycle top garment comprising in combination:

a front, a back, opposing side seams, a bottom opening and a top opening;

an external pocket having an upper edge defining an access opening, said external pocket positioned on said back such that said pocket is exposed when said garment is worn;

a separate pocket elastic band affixed to and extending along said upper edge of said external pocket;

a torso-encircling elastic band;

wherein said pocket elastic band is joined to said torso-encircling elastic band such that pulling on said pocket elastic band pulls on said torso-encircling band and such that pulling on said torso-encircling band pulls on said pocket elastic band, such that stress applied to said pocket elastic band is transferred to said torso-encircling elastic band rather than to said back.

2. The garment of claim 1, further comprising an internal shelf bra comprising an upper opening and a bottom opening, wherein said shelf bra upper opening is integrally connected to said front and said back of said garment, and wherein said shelf bra bottom opening is not integrally connected to said front and back of said garment, wherein said torso-encircling elastic band is joined to said shelf bra bottom opening.

3. The garment of claim 1, wherein said pocket elastic band comprises two ends, and wherein said ends of said pocket elastic band are connected to said torso-encircling band.

4. The garment of claim 3, wherein said ends of said pocket elastic band terminate at said side seams and are connected to said torso-encircling band by stitching.

5. The garment of claim 3, wherein said pocket elastic band extends through said side seams and said ends of said pocket elastic band are connected to said torso-encircling band.

6. The garment of claim 3, further comprising a pair of bridging members, and wherein said bridging members comprise separate elastic bands connecting said ends of said pocket elastic band to said torso-encircling band.

7. A bicycle top garment comprising:

a front, a back, opposing side seams, a bottom opening and a top opening;

an external pocket having an upper edge defining an access opening and a separate pocket elastic band extending along said upper edge;

a torso-encircling elastic band;

wherein said pocket elastic band is joined to said torso-encircling elastic band such that pulling on said pocket elastic band pulls on said torso-encircling band and such that pulling on said torso-encircling band pulls on said pocket elastic band, such that stress applied to said pocket elastic band is transferred to said torso-encircling elastic band;

wherein said pocket elastic band comprises two ends, and wherein said ends of said pocket elastic band are connected to said torso-encircling band; and further comprising a pair of bridging members, and wherein said bridging members connect said ends of said pocket elastic band to said torso-encircling band.

8. The garment of claim 7, wherein said bridging members are elastic.

9. The garment of claim 1, said garment being composed of an elastic material.

10. A bicycle top garment comprising in combination:

a front, a back, opposing side seams, a bottom opening and a top opening;

an external pocket having an upper edge defining an access opening, said pocket upper edge extending completely between said side seams, said external pocket positioned on said back such that said pocket is exposed when said garment is worn;

a torso-encircling elastic band, a rear portion of said torso-encircling elastic band affixed to and extending along said pocket upper edge; and an elastic band segment connected to said torso-encircling elastic band.

11. The garment of claim 10, further comprising an internal shelf bra comprising an upper opening and a bottom opening, wherein said shelf bra upper opening is integrally connected to said front and said back of said garment, and wherein said shelf bra bottom opening is not integrally connected to said front and back of said garment, wherein a forward portion of said torso-encircling elastic band is joined to said shelf bra bottom opening.

12. The garment of claim 11, wherein said elastic band segment is joined to said shelf bra bottom opening.

13. The garment of claim 10, said garment being composed of an elastic material.

14. The garment of claim 7, further comprising an internal shelf bra comprising an upper opening and a bottom opening, wherein said shelf bra upper opening is integrally connected to said front and said back of said garment, and wherein said shelf bra bottom opening is not integrally connected to said front and back of said garment, wherein said torso-encircling elastic band is joined to said shelf bra bottom opening.

15. The garment of claim 2, wherein said pocket elastic band comprises two ends, and wherein said ends of said pocket elastic band are connected to said torso-encircling band.

16. The garment of claim 15, wherein said ends of said pocket elastic band terminate at said side seams and are connected to said torso-encircling band by stitching.

17. The garment of claim 15, wherein said pocket elastic band extends through said side seams and said ends of said pocket elastic band are connected to said torso-encircling band.

18. The garment of claim 15, further comprising a pair of bridging members, and wherein said bridging members comprise separate elastic bands connecting said ends of said pocket elastic band to said torso-encircling band.

* * * * *